United States Patent [19]

Martwick

[11] Patent Number: 5,069,137

[45] Date of Patent: Dec. 3, 1991

[54] CASED TELESCOPED AMMUNITION ROUND

[75] Inventor: Wilford E. Martwick, Minneapolis, Minn.

[73] Assignee: Honeywell Inc., Minneapolis, Minn.

[21] Appl. No.: 524,605

[22] Filed: May 17, 1990

[51] Int. Cl.[5] ..... F42B 5/045

[52] U.S. Cl. ..... 102/434; 102/430; 102/464; 102/469

[58] Field of Search ..... 102/430, 433, 434, 464–470

[56] References Cited

U.S. PATENT DOCUMENTS

| | | | |
|---|---|---|---|
| 1,002,038 | 8/1911 | Clyne | 102/464 |
| 2,938,458 | 5/1960 | O'Brien | 102/430 |
| 3,009,394 | 11/1961 | Kamp et al. | 102/434 |
| 3,955,506 | 5/1976 | Luther | 102/467 |
| 4,565,131 | 1/1986 | Buchner | 102/466 |
| 4,803,927 | 2/1989 | Washburn | 102/434 |
| 4,938,145 | 7/1990 | Martwick | 102/434 |

FOREIGN PATENT DOCUMENTS

| | | | |
|---|---|---|---|
| 487320 | 6/1938 | United Kingdom | 102/469 |

*Primary Examiner*—Harold J. Tudor
*Attorney, Agent, or Firm*—William T. Udseth; Edward W. Hughes

[57] ABSTRACT

A cartridge case 64 for a cased telescoped ammunition round 10. Cartridge case 64 includes a casing 12 having inwardly tapering conical end portions 14, 16 and end seals 20, 22 which undergo elastic deformation when round 10 is fired from a gun. A plurality of spring fingers 62 are formed on portions 14, 16. Conical portions 14, 16 fit into seals 20, 22. Casing 12 is secured to seals 20, 22 by the tips 66 of spring fingers 62 fitting into catch grooves 56, 56' of seals 20, 22. A control tube 24 is secured to rear seal 20 and a primer 30 is mounted in control tube 24. Projectile 26 is mounted within round 10 with its piston 28 located within control tube 24. Main propellant charge 36 is positioned around control tube 24 and round 26. A booster charge 32 is positioned with control tube 24. Axial growth of casing 12 compresses spring fingers 62 retract end seals 20, 22 after firing. Radial expansion of cartridge case 64 is accommodated by elastic deformation of the casing.

12 Claims, 2 Drawing Sheets

CASED TELESCOPED AMMUNITION ROUND

BACKGROUND OF THE INVENTION (1) Field of the Invention

This invention is in the field of cased telescoped ammunition rounds, and more particularly relates to improvements to the cartridge case of such a round to facilitate removal of a fired cartridge case from the chamber of a gun.

(2) Description of Related Art

Cased telescoped ammunition in which the projectile is completely enclosed, or telescoped, within the cartridge case, reduces the volume and weight of a gun system firing cased telescoped ammunition compared with the weight and volume of a gun system using conventionally shaped ammunition rounds having an equivalent rate of fire. The reduced weight and volume for equivalent fire power makes such gun systems desirable for mounting in aircraft, tanks, and other mobile combat vehicles. In this application a gun system is defined to include a gun and its associated ammunition storage and feed subsystems. The benefits of using cased telescoped ammunition in a gun system derive primarily from the cylindrical shape of the cartridge case of each such round.

When a cased telescoped ammunition round is fired, the projectile is initially accelerated by a booster charge to close, or to obturate, the barrel of the gun before the main propellant charge is ignited. A control tube is commonly used to control the initial movement of the projectile. A booster charge is located in the control tube and is separated by the tube from the main propellant charge. Products of the ignited booster charge are initially confined within the control tube by a booster piston attached to the base of the projectile. Main charge ignition, thus, does not occur until the advancing piston clears the tube or exposes, or unblocks, ignition ports in the wall of the control tube which permits products of the burning booster charge to ignite the main charge. Ignition of the main charge is controlled by the position of the projectile and its booster piston relative to the control tube.

The external surfaces of the cartridge case of a typical cased telescoped ammunition round are formed by a cylindrical outer casing, or skin, and two caps, or end seals, a front seal and a rear seal. Each such round is loaded into a cylindrical gun chamber, or chamber, of the gun from which the round is to be fired and from which the spent cartridge case is removed, or unloaded, after firing and before another cycle of loading, firing, and unloading begins. In guns from which such rounds are typically fired, the chamber housing in which a number of gun chambers may be formed can take the form of a cylinder which is rotated about its axis of symmetry similar to the rotation of the cylinder of a hand held revolver, for example. In such a gun system the rounds are mechanically loaded into a given gun chamber when that chamber has a given orientation, position or station, relative to the gun barrel. The chamber housing is then rotated to bring the gun chamber into which a round has been loaded into alignment with the gun barrel ready for firing. After firing, the chamber housing is again rotated to another position so that the gun chamber with the cartridge case of the fired round, the spent cartridge case, can be removed from the gun chamber. Alternatively, the chamber housing may be moved linearly with respect to the gun barrel to position a gun chamber in a loading station where a round can be loaded into the chamber. The chamber housing is then moved to align the loaded gun chamber with the gun barrel. When the round is fired, the chamber housing is moved so that the gun chamber with the spent cartridge case is at its unloading station and the spent cartridge case is removed from the chamber prepatory to another round being loaded into it. In such a gun, the loading and unloading stations for a given chamber may be the same. Cased telescoped ammunition obviously can also be fired from more conventionally operating guns firing projectiles of from 20 to 45 mm, for example.

When the interior of the cartridge case is pressurized by the burning of the propellant within the cartridge, the outer skin, or outer casing, and the end seals function to prevent gun gas from escaping between the the chamber housing and the breech and barrel faces of the the gun. The pressure created by the burning propellant forces the end seals apart until they are constrained by the breech face of the gun forming one end of the gun chamber and by the the barrel face of the gun barrel which forms the other end of the gun chamber. This pressure also forces the lips of the end seals and the outer casing, or skin, of the cartridge case radially outward into intimate contact with the inner cylindrical surface of the gun chamber formed in the chamber housing. After such contact has been achieved, the pressure produced by the burning propellant acts to elastically deform the chamber housing, enlarging the diameter of the gun chamber and forcing apart the breech face and the barrel face of the gun. When the pressure within the cartridge case is relieved after the projectile exits the muzzle of the gun barrel, the gun and the chamber revert to their unpressurized dimensions. However, changes in the dimensions of the cartridge case experienced during firing can cause nonelastic changes in the dimensions of the cartridge case, so that the dimensions of the cartridge case do not return to the dimensions they possessed prior to the round being fired.

To extract a spent cartridge case after it has been fired, it is necessary in a gun with a movable chamber housings to move the chamber housing so that the gun chamber in which the spent cartridge case is located can be moved to its unloading position, or station. For such movement to take place as quickly as possible while requiring the minimum amount of force to accomplish such movement, it is necessary that there be sufficient clearance between the end seals of the spent cartridge and the breech face and the barrel face of the gun to minimize frictional resistance to the movement of the chamber housing. To quickly and easily remove the spent cartridge case from the gun chamber, it is important that the cartridge casing not press against the inner cylindrical surface of the gun chamber and that the spent cartridge case be sufficiently intact so that all components of the spent cartridge case can be removed together, or as an entity.

Because the elastic deformation occurring in a gun firing cased telescoped ammunition is so large, there is a need for an improved cartridge case for a cased telescoped ammunition round that provides adequate and proper clearance between the end seals and the breech face and the barrel face of the gun after the round has been fired as well as between the cartridge casing and the surface of the gun chamber while maintaining the integrity of the spent cartridge casing to facilitate its removal.

To reduce the pressure exerted by the outer casing, or skin, of a spent cartridge case of such a round on the surface of the gun chamber within which the round is fired, and thus the force needed to remove the spent cartridge case, the skin, or outer casing, can be designed to split longitudinally when fired which minimizes any pressure exerted by the outer casing against the inner surfaces of the gun chamber after the gun chamber returns to its initial dimensions, the dimensions it had immediately prior to the round being fired. In such rounds the end seals are free to move relative to the outer casing which requires special means to maintain the integrity of the casing i.e., the necessary degree of connection between the end seals and the split casing so that they can be removed as a single entity. Typically, the joint between the end seals and the casing includes a sealant to prevent moisture and contaminants from entering the round, but such joints are not strong enough to maintain the integrity of a spent cartridge case with the degree of reliability required so that the problem of removing a spent cartridge case as a single entity quickly, and completely with a minimum amount of energy is not consistently achieved.

SUMMARY OF THE INVENTION

The present invention provides an improved cartridge case for a cased telescoped ammunition round. The cartridge case of the round includes an outer casing having a cylindrical center portion and inwardly tapering end portions the axis of which is also the axis of symmetry of the round, front and rear seals, a control tube and an igniter. The outer casing is fabricated from a material which undergoes elastic deformation when the round is fired. The front and rear seals each have a base and an annular side wall formed integrally with its base. The side wall of each seal has a cylindrical outer surface and an outwardly tapering inner conical surface. The side wall of each seal terminates in a thin lip at the open end of the cap, or seal. On the tapered inner conical surface, a stop shoulder is formed against which an end portion of the outer casing abuts when the round is assembled. An annular catch groove is formed in the inner surface of each seal to accommodate the ends of spring fingers formed in the end portions of the casing. Assembly of the end seals to the outer casing is accomplished by snapping the end seals onto the inwardly tapering portions of the outer casing. A hollow cylindrical control tube is attached to the rear seal so that the control tube is symmetric with the axis of symmetry of the round. A projectile which has a booster piston secured to its base is positioned in the cartridge case with the booster piston located in the control tube. A booster propellant is positioned within the control tube between the primer, or igniter, and the free end of the booster piston. The primer which ignites the booster propellant is mounted in the rear of the control portion of the control tube. The main propellant charge is positioned around the control tube and the projectile, within the outer casing and between the front and rear seals.

Axial displacement of the round, or casing, occurs when the round is fired. This change in dimension is accommodated by the spring fingers formed in the front and rear portions of the casing which engage, or project into a catch groove formed in the end seals. The spring fingers are bent, or are compressed, by the axial expansion of the cartridge case as the pressure of the gases within the cartridge case reach their maximum during firing. When the pressure of the gun gases within the cartridge case returns to normal, or ambient, values the spring fingers retract the end seals so that the overall length of the cartridge case after firing is less than the distance between the breech and barrel faces of the chamber, approximating its original length. The increase in the circumference of the outer casing, or its radial displacement, occurring during firing expands the tubular central section of the outer casing. However when the pressure within the cartridge case returns to normal, the circumference of the outer casing of the spent round, or cartridge case, substantially returns to its initial value because during firing it has undergone elastic deformation. As a result, the seals do not press against the barrel face and breech face of the gun after the round is fired, and no significant frictional force is present to oppose movement of the chamber housing due to the seals pressing against the barrel face and breech face of the gun after a round is fired. Since the outer casing is made of a material that undergoes primarily elastic deformation when the round is fired, the diameter or circumference of the outer casing substantially returns to its initial value. As a result, there is no significant resistance provided by the outer casing pressing against the chamber housing when the spent round is removed from the chamber. The only connection between the end seals, or the end caps, is provided by the spring fingers formed in the end portions of the outer casing which engage the catch grooves formed in the inner surfaces of the end seals of the assembled round.

It is, therefore, an object of this invention to provide an improved cartridge case for a cased telescoped ammunition round in which the only connection between the front and rear seals of the cartridge case is provided by spring fingers of the end portions of the outer casing engaging a spring catch groove with which each end seal is provide.

It is another object of this invention to provide a cartridge case for a cased telescoped ammunition round that facilitates removal of the cartridge case from the gun chamber of a gun from which the round was fired.

It is yet another object of this invention to provide a cartridge case for a cased telescoped ammunition round in which the outer casing of the cartridge case is fabricated from a material which undergoes elastic deformation when the round is fired and in which the end seals are retracted after a round is fired by action of spring fingers formed in the inwardly tapered conical end portions of the outer casing acting on a catch groove formed in the inner surface of each end seal.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be affected without departing from the spirit and scope of the novel concepts of the disclosure, and in which.

DETAILED DESCRIPTION

Figure 1:
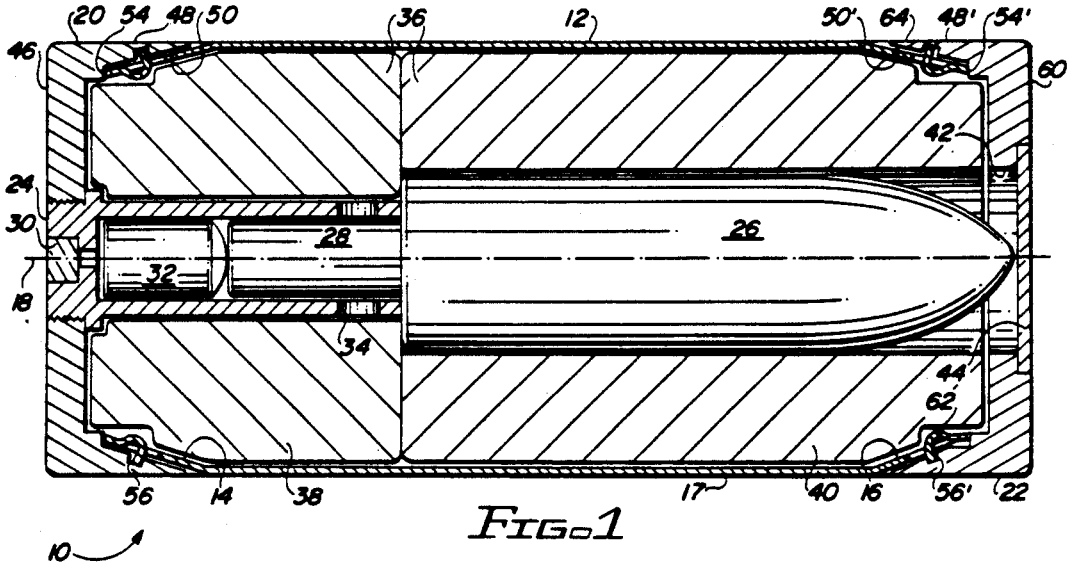
FIG. 1 is a section of a preferred embodiment of a cased telescoped ammunition round embodying this invention.

In FIG. 1 cased telescoped ammunition round 10 includes an outer casing, or skin, 12, which has an inwardly tapered conical rear portion 14 and an inwardly tapered conical front portion 16 and a center section 17 which is a right circular hollow cylinder. Axis 18 of round 10 is the axis of symmetry, or longitudinal axis of casing 12. Rear portion 14 of outer casing 12 fits into rear seal 20 to close off the rear end of casing 12, and front portion 16 of outer casing 12 fits into front seal 22 to close off the front end of casing 12. Control tube 24 is also a right circular hollow cylinder one end of which is secured to rear seal 20 so that the axis of symmetry, or longitudinal axis of control tube 24 substantially coincides with axis 18.

Projectile 26 is provided with a booster piston 28, which is mounted on the base of projectile 26. When round 10 is assembled, booster piston 28 is positioned within a portion of control tube 24. Primer, or igniter, 30 is mounted in the rear end of control tube 24, and booster charge 32 is positioned within control tube 24 between booster piston 28 and igniter 30. Ignition ports, or vents, 34 are formed through the side walls of control tube 24. Vents 34 are initially blocked, or closed, by booster piston 28. Two segments of the main propellant 36 of round 10, rear segment 38 and front segment 40 are positioned around control tube 24 and projectile 26 within casing 12 and between end seals 22 and 24. Segments 38, 40 may be divided into sections to maximize utilization of the space within round 10 available for main propellant charge 36. The elements of main propellant charge 36 are formed by consolidating propellant grains. The inner diameter of the central opening through front segment 40 is greater than that of rear segment 38 so that front segment 40 can fit around projectile 26. The central opening 42 in front seal 22 is closed by environmental seal 44 which is made of a suitable material, such as aluminum foil. The function of seal 44 is to prevent elements of the environment external to round 10 such as moisture, dirt, etc. from entering round 10 and adversely impacting the performance of the round.

Figure 2:
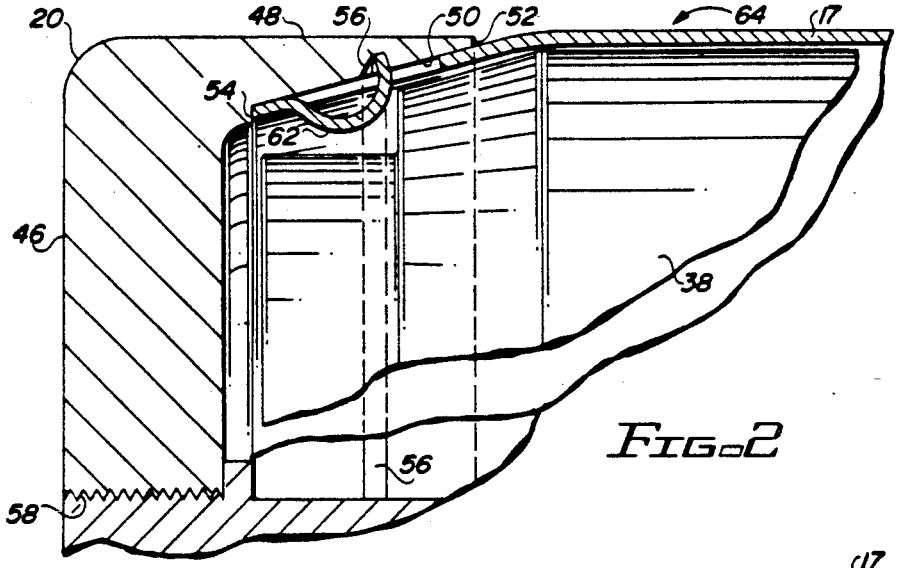
FIG. 2 is an enlarged fragmented sectional view of an end seal showing the position of a spring finger formed in the tapered end portion of the outer casing and the catch groove of an end seal when the round is assembled but prior to being fired.

In FIG. 2 details of end seals 20, 22, particularly with reference to rear seal 20, relevant to this invention are illustrated. Rear seal 20 has a base 46 and an annular side wall 48. Side wall 48 has a cylindrical outer surface and an outwardly tapering conical inner surface 50. Side wall 48 terminates in a thin lip 52. A stop shoulder 54 is formed around the interior of side wall 48. Annular spring finger catch groove 56 is formed in the inner surface 50 of rear seal 20. Since in FIG. 2 rear seal 20 is illustrated, the base 46 of rear seal 20 is provided with a threaded opening 58 into which one end of control tube 24 is threaded as illustrated in FIG. 1.

Except for the diameter of opening 42 in base 60 of front seal 22 which is made large enough so that projectile 26 can pass through it when round 10 is fired, front seal 22 is substantially the equivalent of rear seal 20. Thus, elements of front seal 22 which are substantially the same as those of rear seal 20 have the same reference number except for the reference number being primed.

Figure 5:
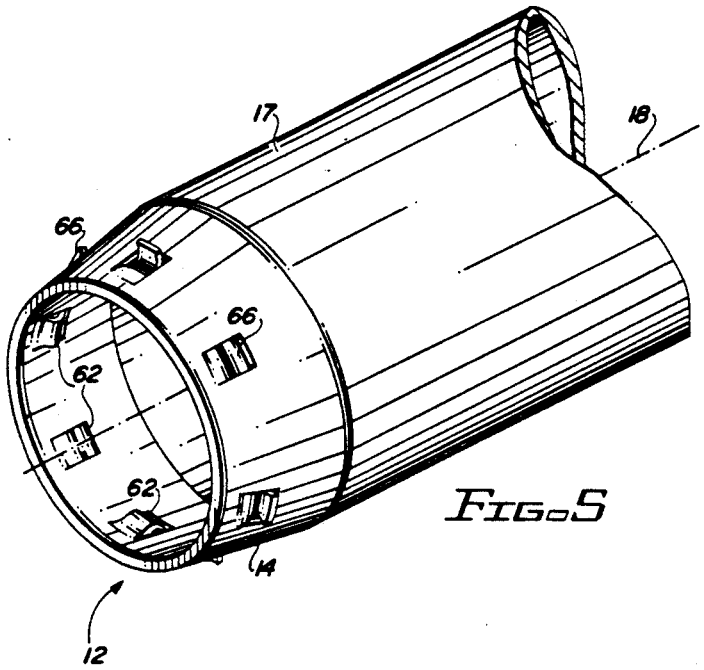
FIG. 5 is a fragmentary perspective of a tapered end portion of the outer casing.

In the preferred embodiment outer casing 12 is made out of a material which has a high yield to strength modulus ratio such as 17-7 stainless steel. Other materials have substantially the same ratio as 17-7 stainless steel can also be used. Titanium is one such material. Rear and front portions 14, 16 of outer casing 12 are tapered inwardly so that they can fit within the annular side walls 48, 48' of seal 20, 22 as seen in FIG. 1. A plurality, three, four, six, or eight uniformly spaced substantially uniformly curved spring fingers 62 are formed in each tapered conical portion 14, 16. Additional details of tapered end portion 14 of casing 12, are illustrated in FIG. 5. Tapered end portion 16 is substantially identical to end portion 14. When round 10 is assembled, the joints between seals 20, 22 and portions 14, 16 of casing 12 are environmentally sealed by a sealant such as a room temperature vulcanizing silicone which is not illustrated. A significant advantage of round 10 is that in assembling round 10 rear seal 20 can be snapped onto rear portion 14 of casing 12, and front seal 22 can be similarly snapped onto front portion 16 of casing 12. Casing 12 and end seals 20, 22 are secured to each other by the free end of each spring finger 62 each of which projects into catch grooves 56, 56' of seals 20, 22.

In a typical gun system which is not illustrated, a round 10 is loaded into a gun chamber in a chamber housing of the gun. The housing is moved to align the chamber containing round 10 with the gun barrel. The gun chamber is defined by a breech face, the inner cylindrical surface of the gun chamber, and the face of the gun barrel. Round 10 is fired by a mechanism in the breech of the gun which drives a firing pin into primer 30, or discharges an electrical current through primer 30. Primer 30 when initiated, ignites booster charge 32. Pressure of the gases released by burning booster charge 32 act on the exposed end of booster piston 28 to accelerate projectile 26 out of round 10 into the forcing cone of the gun barrel. As projectile 26 moves forward, booster piston 28 exposes, or unblocks, vents 34 in control tube 24 so that the ignition products produced by booster charge 32 ignite main propellant 36. Burning propellant 36 produces gases developing a very high pressure and temperature that act against seals 20, 22 and outer casing 12, as well as on projectile 26 to accelerate projectile 26 to a desired muzzle velocity as projectile 26 exits the gun barrel.

As the pressure of the gases, gun gas, produced by burning propellant 36 increases, this pressure acting on end portions 14 16 of casing 12 is transmitted to the side walls 48, 48' to expand them so that they press against the wall of the gun chamber with sufficient force to seal the chamber so that no hot gun gas produced by the burning propellant 38 impinges on the wall of the gun chamber and no such gas can escape from the gun chamber between the chamber housing and the breech and barrel faces of the gun. The pressure of the gun gas forces end seals 20, 22 apart until they are constrained by the breech and barrel faces of the gun. This pressure also forces the outer casing 12 outwardly against the inner cylindrical surface of the chamber housing in which the gun chamber is formed. After such contact has been established and as the pressure of the gas within cartridge case 64 which includes casing 12 and end seals or caps 20, 22 approaches its maximum, this pressure is sufficient to elastically deform the chamber housing, enlarging the diameter of the gun chamber as well as forcing apart the breech and barrel faces of the gun.

Figure 3:
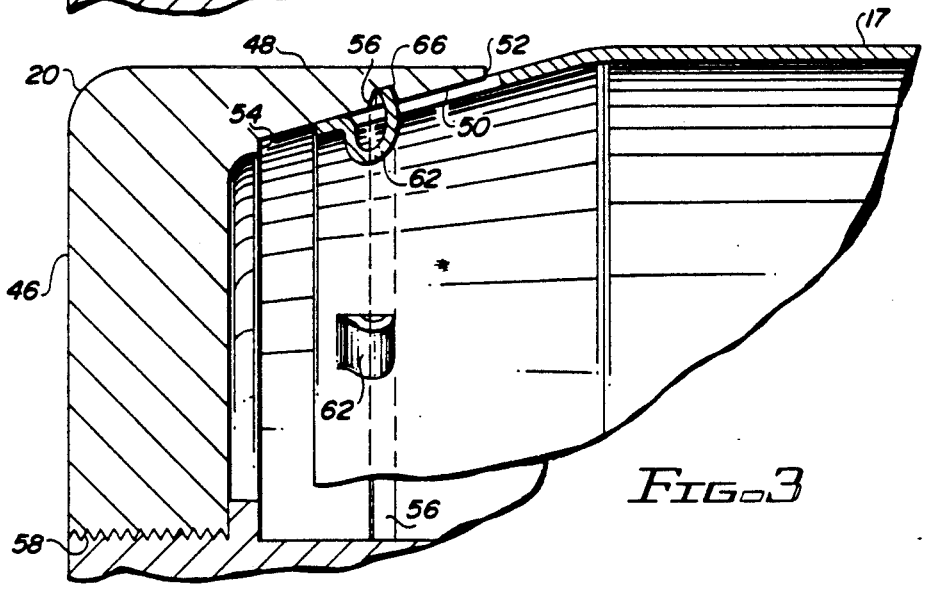
FIG. 3 is an enlarged fragmented sectional view similar to FIG. 2 showing axial displacement of the outer casing relative to the end seal when the pressure of the burning propellant of the round is at its maximum.

Axial growth of cartridge case 64 is accommodated by curved spring fingers 62 which are compressed as end seals 20, 22 move apart as seen in FIG. 3 which illustrates the relative magnitude of such movement at the time the pressure within cartridge case 64 is at its maximum.

Figure 4:
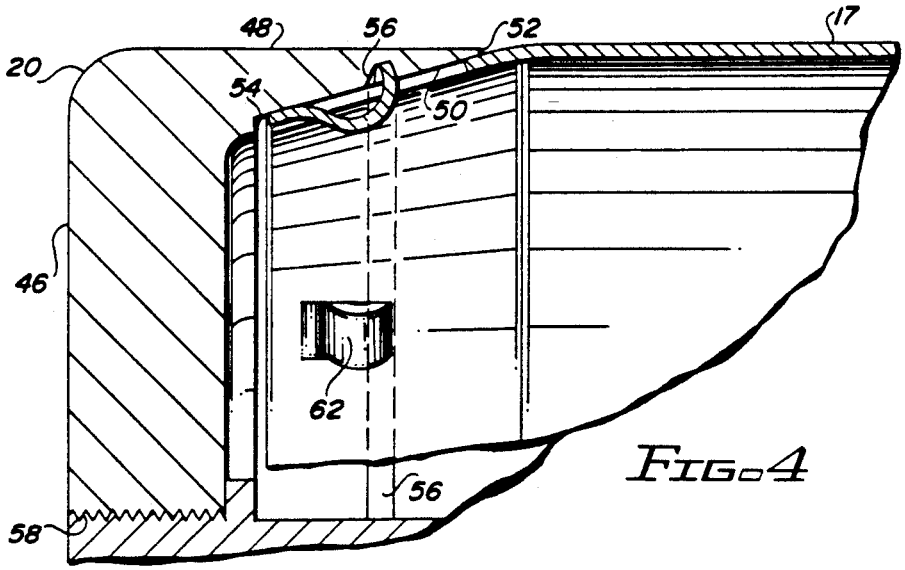
FIG. 4 is an enlarged fragmented sectional view similar to FIG. 2 showing the position of the outer casing relative to an end seal after the round has been fired.

After projectile 26 exits the muzzle of the barrel, the pressure within cartridge case 64 quickly decreases toward ambient at which time the gun and its chamber housing revert substantially to their unpressurized dimensions. When the pressure within the cartridge case 64 returns to normal, or ambient, seals 20, 22 which undergo elastic deformation during firing substantially return to their original dimensions; and compressed, substantially semicircular, in a plane within which axis 18 lies spring fingers 62 expand in returning to their initial assembled state to retract end caps 20, 22. FIG. 4 illustrates the relationship between rear portion 14 of casing 12 and rear seal 20 after round 10 has been fired and the pressure within cartridge case 64 has returned to substantially ambient conditions. While the overall length of cartridge case 64 is slightly greater than prior to firing it is still less than the length of the gun chamber, or the distance between the breech and barrel faces of the gun chamber. Thus, there is no significant frictional force present to oppose movement of the chamber housing of the gun caused by seals 20, 22 pressing against the breech and barrel faces of the gun.

Radial clearance between casing 12 and the cylindrical surface of the chamber housing defining the gun chamber after round 10 is fired is attained because the yield strength of casing 12 divided by the modulus of the material from which casing 12 is made, 17-7 stainless steel in the preferred embodiment, is greater than the elastic deformation in inches/inch of the diameter of the gun chamber. As a result casing 12 will substantially return to its original state, or dimensions, where its diameter is less than the diameter of the gun chamber. Thus, no significant frictional force is created by casing 12 pressing against the surfaces of the gun chamber to resist removal of cartridge case 64.

Because seals 20, and 22 are secured to casing 12 by the tips 66 of spring fingers 62 engaging spring catch grooves 56, 56', casing 12 remains intact after round 10 is fired, and the integrity of the spent cartridge case 64 is maintained so that all the elements of spent cartridge case 64 can be removed from a gun chamber from which round 10 is fired as an entity and with a minimum expenditure of energy.

From the foregoing, it is readily apparent the the present invention provides an improved cartridge case for a cased telescoped ammunition round that is easily assembled and provided positive length control. It should, therefore, be evident that various modification can be made to the described invention without departing from the scope of the present invention.

What is claimed is:

1. A cartridge case 64 for a cased telescoped ammunition round 10 comprising:

an outer skin 12 having an outer surface, a rear end portion 14, a front end portion 16, and an axis of symmetry 18, said outer skin 12 being fabricated from a material which undergoes elastic deformation when round 10 is fired; and said outer skin 12 having a plurality of curved spring fingers 62 formed in the end portions 14, 16 of the outer skin 12, each finger 62 having a free end 66 with only the free end of each finger 62 projecting beyond the outer surface of outer skin 12;

a rear seal 20;

a front seal 22;

the real seal 20 and the front seal 22 each having a base 46, 60 and an annular side wall 48, 48'; each side wall 48, 48' of seals 20, 22 having a cylindrical outer surface, and an inner surface 50, 50' terminating in a lip 52 52', catch means 56, 56' formed in the inner surface 50, 50' of the side wall 48, 48' of each seal 20, 22; the rear portion 14 of outer skin 12 fitting into rear seal 20 with the outer surface of rear portion 14 substantially contacting the inner surface 50 of rear seal 20 and front portion 16 of outer skin 12 fitting into front seal 22 with the outer surface of front portion 16 substantially contacting the inner surface 50' of front seal 22, the free ends 66 of spring fingers 62 projecting into catch means 56, 56' to secure seals 20, 22 to outer skin 12;

a hollow cylindrical control tube 24 having a front end and a rear end, the rear end of control tube 24 being secured to the base 46 of rear seal 20 so that control tube 24 is substantially symmetrical with respect to axis 18, the front end of the control tube 24 being spaced from front seal 22; and primer means 30 mounted in the base of the rear seal.

2. The cartridge case of claim 1 in which outer skin 12 is fabricated from 17-7 stainless steel.

3. The cartridge case of claim 2 in which the rear portion 14 and front portion 16 of hollow cylindrical skin 12 taper inwardly.

4. The cartridge case of claim 3 in which the inner surfaces 50, 50' of seals 20, 22 are conical surfaces as are the outer surfaces of end portions 14, 16.

5. A cartridge case 64 for a cased telescoped ammunition round 10 comprising:

a hollow outer skin 12 having a rear portion 14 having an outer conical surface, a front portion 16 having an outer conical surface, a cylindrical middle portion 17 and an axis of symmetry 18, a plurality of curved spring fingers 62 formed in the front and rear portions 14, 16, each finger having a free end and only the free end of a spring finger projecting beyond the outer conical surface, said outer skin 12 being formed from a material which undergoes elastic deformation when round 10 is fired;

a rear seal 20;

a front seal 22;

the real seal 20 and the front seal 22 each having a base 46, 60 and an annular side wall 48, 48' integral with its base, each side wall 48, 48' of seals 20, 22 having a cylindrical outer surfaces and an outwardly tapering inner conical surface 50, 50' terminating in a lip 52, 52', a catch groove 56, 56' and a shoulder stop 54 54' formed in the inner surfaces 50, 50' of the side wall 48, 48' of seals 20, 22, the rear portion 14 of outer skin 12 fitting into rear seal 20, contacting shoulder stop 54, and the free end of each spring finger 62 engaging catch groove 56, and the front portion 16 of outer skin 12 fitting into front seal 22 contacting shoulder stop 54' and spring fingers 62 engaging catch groove 56';

a hollow cylindrical control tube 24 having a front end and a rear end, the rear end of control tube 24 being secured to the base 46 of rear seal 20 so that control tube 24 is substantially symmetrical with respect to axis 18, the front end of the control tube 24 being spaced from front seal 22; and primer means 30 mounted in the base 46 of rear seal 20.

6. A cartridge case as set forth in claim 5 in which outer skin 12 is fabricated from 17-7 stainless steel.

7. The cartridge case of claim 5 in which inner conical surfaces 50, 50' of seals 20, 22 are in substantial contact with the conical outer surfaces of the rear portion 14 and the front portion 16.

8. The cartridge case of claim 7 in which the spring fingers 62, 62' are integral with outer skin 12.

9. A cased telescoped ammunition round 10 comprising:

a hollow outer skin 12 having a rear portion 14 having an outer conical surface, a front portion 16 having an outer conical surface, a cylindrical middle portion 17 and an axis of symmetry 18, a plurality of curved spring fingers 62 formed in the front and rear portions 14, 16, each of said spring fingers having a free end, only the free end of each spring finger projecting beyond the outer conical surface of the front and rear portions of the outer skin, and each of said free ends being substantially perpendicular to the outer surface of the front and rear portions of the outer skin said outer skin 12 being formed from a material which undergoes elastic deformation when round 10 is fired;

a rear seal 20;

a front seal 22;

rear seal 20 and front seal 22 each having a base 46, 60 and an annular side wall 48, 48' integral with its base, each side wall 48, 48' of seals 20, 22 having a cylindrical outer surfaces and an outwardly tapering inner conical surface 50, 50' terminating in a lip 52, 52', a catch groove 56, 56' and a shoulder stop 54, 54' formed in the inner surfaces 50, 50' of the side walls 48, 48' of each seal 20, 22, the rear portion 14 of outer skin 12 fitting into rear seal 20, contacting shoulder stop 54; and the free end of each of the spring fingers 62 of rear portion 14 engaging catch groove 56; and the front portion 16 of outer skin 12 fitting into front seal 22, contacting shoulder stop 54'; and the free end of each of the spring fingers 62 of front portion 16 engaging catch groove 56';

a hollow cylindrical control tube 24 secured to base 46 of rear seal 20 so that control tube 24 is substantially symmetrical with respect to axis 18;

a projectile 26; a portion of projectile 26 fitting into control tube 24;

a main propellant charge 36 positioned around control tube 24, within casing 12 and between the rear and front seals 20, 22;

a booster propellant 32 positioned within control tube 24; and primer means 30 mounted in control tube 24 for igniting booster propellant 32 and main propellant charge 36 when primer means 30 is initiated when round 10 is fired;

axial growth of cartridge case 64 occurring when round 10 is fired from a gun chamber of a gun, being accommodated by compressing spring fingers 62; when the pressure of gases produced by the ignited main propellant charge within cartridge case 64 returns to ambient, spring fingers 62 expand to retract end seals 20, 22.

10. A case telescoped ammunition round 10 as set forth in claim 9 in which outer casing 12 is fabricated from 17-7 stainless steel.

11. A cased telescoped ammunition round 10 as set forth in claim 9, in which the outer conical surfaces of rear portion 14 and front portion 16 are in substantial contact with the inner conical surfaces 50, 50' of seals 20, 22.

12. A cased telescoped ammunition round 12 as set forth in claim 11 in which spring fingers 62 of portions 14, 16 are integral with outer skin 12.

* * * * *